United States Patent [19]

Kraemer

[11] Patent Number: 4,976,439

[45] Date of Patent: Dec. 11, 1990

[54] YARD CASTING ASSEMBLY

[75] Inventor: Sandy F. Kraemer, Colorado Springs, Colo.

[73] Assignee: New Discovery Ventures, Ltd., Colorado Springs, Colo.

[21] Appl. No.: 439,477

[22] Filed: Nov. 21, 1989

[51] Int. Cl.[5] ..... A63B 67/10; A63B 69/00

[52] U.S. Cl. ..... 273/350; 273/140; 273/348; 273/330

[58] Field of Search ..... 273/350, 140, 317, 345, 273/348, 407, 330; 43/42.25

[56] References Cited

U.S. PATENT DOCUMENTS

| | | | |
|---|---|---|---|
| 420,149 | 1/1890 | Elson | 273/140 |
| 1,456,308 | 5/1923 | Haigh | 273/140 |
| 1,551,685 | 9/1925 | O'Brien | 273/140 |
| 2,146,194 | 2/1939 | Rubens et al. | 273/140 |
| 2,320,145 | 5/1943 | La Due | 273/350 |
| 2,598,487 | 5/1952 | Anechiarico | 273/140 X |
| 2,611,617 | 9/1952 | Strohm | 273/140 |
| 2,683,323 | 7/1954 | Dudley | 43/42.25 |
| 2,703,469 | 3/1955 | Raizen | 273/140 X |
| 3,463,494 | 8/1969 | Stroh | 273/345 |
| 3,620,532 | 11/1971 | Graf | 273/140 X |
| 3,788,641 | 1/1974 | Lemelson | 273/140 X |
| 4,364,570 | 12/1982 | Hallam | 273/407 X |

*Primary Examiner*—William H. Grieb
*Attorney, Agent, or Firm*—Phillip A. Rein

[57] ABSTRACT

This invention relates to a yard casting assembly having a main target assembly; a casting connector assembly secured to an upper surface of the main target assembly; and a casting wedge member connectable to a fishing line on a casting rod and reel assembly for casting outwardly to engage the casting connector assembly. The main target assembly can resemble fish structures, wild animals, or other structures of various shapes and includes a main base member having an upright indicator member connected thereto. The casting connector assembly is provided with a plurality of adjacent catching body members adapted to receive the casting wedge member therebetween. The casting wedge member is provided with a main body member having a wedge section to be wedged between adjacent ones of the casting connector assembly. In a second embodiment, the main target assembly includes a main base member which can be (1) of an oval or circular shape; (2) constructed of a floatable material to float on a surface of a lake, pond, or swimming pool; and (3) provided with a plurality of catching body members in alignment about an outer periphery. The second embodiment includes a casting wedge member with feather members to resemble a fly casting lure. The yard casting assembly can be utilized in a method of game play testing one's skill to place the casting wedge member between the adjacent catching body members and as a means of improving the casting skills of the fisherman.

21 Claims, 3 Drawing Sheets

12
14
16
18
20
22
24
25
26
28
30
32
33
34
35
36
37
38
40
42
44
46
48
50
52
54
72
74
5
5

YARD CASTING ASSEMBLY

PRIOR ART

A patent search on this invention revealed the following U.S. Patents:

| U.S. Pat. No. | Invention | Inventor |
|---|---|---|
| 420,149 | GAME APPARATUS | James Elson |
| 1,456,308 | APPLIANCE FOR PLAYING FISHING GAMES | William C. Haigh |
| 1,551,685 | GAME | Peter T. O'Brien |
| 2,146,194 | GAME DEVICE | H. A. Rubens et al |
| 2,598,487 | FISHING GAME | Louis J. Anechiarico |
| 2,611,617 | FISHING GAME | Edward J. Strohm |
| 2,703,469 | TOY FISH | Charles S. Raizen |
| 3,463,494 | PRACTICE DEVICE FOR CATCHING FISH | Patricia A. Stroh |
| 3,788,641 | MANIPULATION GAME | Jerome H. Lemelson |
| 4,364,570 | ROPING TRAINING AID | Delbert W. Hallam |

The Haigh, Elson, O'Brien, and Rubens et al patents disclose numerous types of fish game structures utilizing a plurality of fish members having an eyelet thereon adapted to be grasped by a hook member connected to a line connected to a fishing pole.

The Anechiarico patent discloses a fishing game utilizing a rod and reel structure and a plurality of various types of fish members. This fishing game utilizes either a hook and eye structure atttached to a mouth portion of the respective fish members or magnetic blocks.

The Strohm patent discloses a fishing game having a card with a fish member thereon and a pair of prongs which are to be grasped by ring attached to a fishing line and pole.

The Raizen patent discloses a toy fish having an upright fin member which can be mounted on a support ground or in the water and utilizes a fish hook to catch the toy fish.

The Stroh patent discloses a practice device for catching fish and utilizes an operator with a rod and reel casting a fishing line having a first member on an outer end thereof. The fishing line with the first member attached thereto is casted to place same into a trough-like structure and the magnetic attraction thereof allows the pieces to be joined together as noted in FIG. 4. This is a rather complex structure compared to the applicant's invention.

The Lemelson patent discloses a game structure utilizing numbered fish structures each having a fin member and utilizing VELCRO connectors.

The Hallam patent discloses a rope training aid which basically teaches a pair of spaced horns to which a rope, similar to a fishing line, is tossed. In this case, the rope is placed about the horns and not between catching knobs or wedge members and, thus, is dissimilar in operation relative to applicant's invention.

PREFERRED EMBODIMENT OF THE INVENTION

In one preferred embodiment of this invention, a yard casting assembly is operable to be utilized in combination with an operator having a casting rod and reel assembly either as a game structure or as a means of improving the skills of a fisherman in the area of fly casting and fishing with lures. The casting rod and reel assembly is a standard rod member having a reel member thereon with a fishing line which is attached at an outer end thereof to a portion of the yard casting assembly of this invention. The yard casting assembly includes (1) a main target assembly to be placed on a support surface; (2) a casting connector assembly mounted on the main target assembly; and (3) a casting wedge member connected to the fishing line member and releasably engagable with the casting connector assembly during use thereof. The main target assembly includes a main base assembly having an upright indicator member connected thereto. The main base member can be of various shapes such as resembling the outline of a fish member to be supported on one side on a support surface such as a grassy surface of floating on a water surface. The upright indicator member may be an upright fin member to resemble a shark fin or the like to aid in its visibility as a target member. The casting connector assembly include a plurality of catching body members resembling upright stakes or golf tees which are equally spaced and operable to receive the casting wedge member between adjacent ones thereof in wedging action. The casting wedge member includes a main body member integral with a connector member which is secured to the fishing line for a casting operation. A second embodiment of the yard casting assembly is provided with a main target assembly having a main base member with an upright indicator member secured thereto. The main base member may be of an oval or circular shape adapted to be rested on the support surface with the upright indicator member of a generally square or rectangular shape. The upright indicator member can be provided with numerous indicia thereon such as pictures of animals or the like which may be utilized in a method of game play of this invention. The upright indicator member may be provided with numbers thereon to indicate the points to be awarded on retrieving the main target assembly. This embodiment of the yard casting assembly is provided with two sets of the casting connector assembly, each mounted on opposite sides of the upright indicator member. A casting wedge member is provided which is similar to the previously described casting wedge member except having a main body member which can be provided with a plurality of feather members thereon so as to be readily visible after casting thereof and resemble a fishing fly lure. The main target assembly can be of the circular shape with a casting connector assembly spaced about an outer periphery. The casting connector assembly (1) receives the casting wedge member therebetween in a wedging action; and (2) is provided with number indicia to be used in a method of game play. It is noted that the yard casting assembly of this invention can be utilized (1) as a recreational game structure whereupon points can be awarded for retrieving of the main target assembly; and (2) to provide a casting target so as to improve the casting skills of a fisherman.

OBJECTS OF THE INVENTION

One object of this invention is to provide a yard casting assembly to be used by an operator having a casting rod and reel assembly and includes a casting wedge member secured to a fishing line for casting the wedge member toward a main target assembly which is provided with a casting connector assembly engagable with the casting wedge member for subsequent retrieving of the main target assembly as a recreational game structure.

Another object of this invention is to provide a yard casting assembly including (1) a main target assembly resembling a fish structure; (2) a casting connector assembly mounted on the main target assembly; and (3) a casting wedge member attachable to an outer end of a fishing line connected to a casting rod and reel assembly whereupon the casting wedge member is thrust outwardly in an attempt to be engaged in a wedged action with the casting connector assembly in order to improve the casting skills of the operator thereof.

One other object of this invention is to provide a yard casting assembly having a main target assembly of an oval shape having an upright indicator member thereon and a casting connector assembly having sets of catching body members that can be engaged with a casting wedge member as recreational game structure with skill points awarded depending on the accuracy of a casting operation to wedge the casting wedge member between adjacent ones of the catching body members.

An additional object of this invention is to provide a yard casting assembly including a floatable main target assembly of a circular plate shape having a casting connector assembly with a plurality of catching body members about an outer periphery with number indicia therebetween used in a method of game play.

One further object of this invention is to provide a yard casting assembly including a main target assembly resembling a fish structure and having a casting wedge member to be inserted between adjacent catching body members on the main target assembly for retrieving the main target assembly and the fish structure has an upright fin section and an arcuate tail section which creates a wiggling movement to the fish structure on retrieving same.

Still, one other object of this invention is to provide a yard casting assembly which is attractive in appearance; economical to manufacture; easy to use; substantially maintenance free; and providing entertainment and/or a casting skill improvement device to an operator utilizing same.

Various other objects, advantages, and features of the invention will become apparent to those skilled in the art from the following discussion, taken in conjunction with the accompanying drawings, in which:

FIGURES OF THE INVENTION

Figures 1, 2, 3, 4:
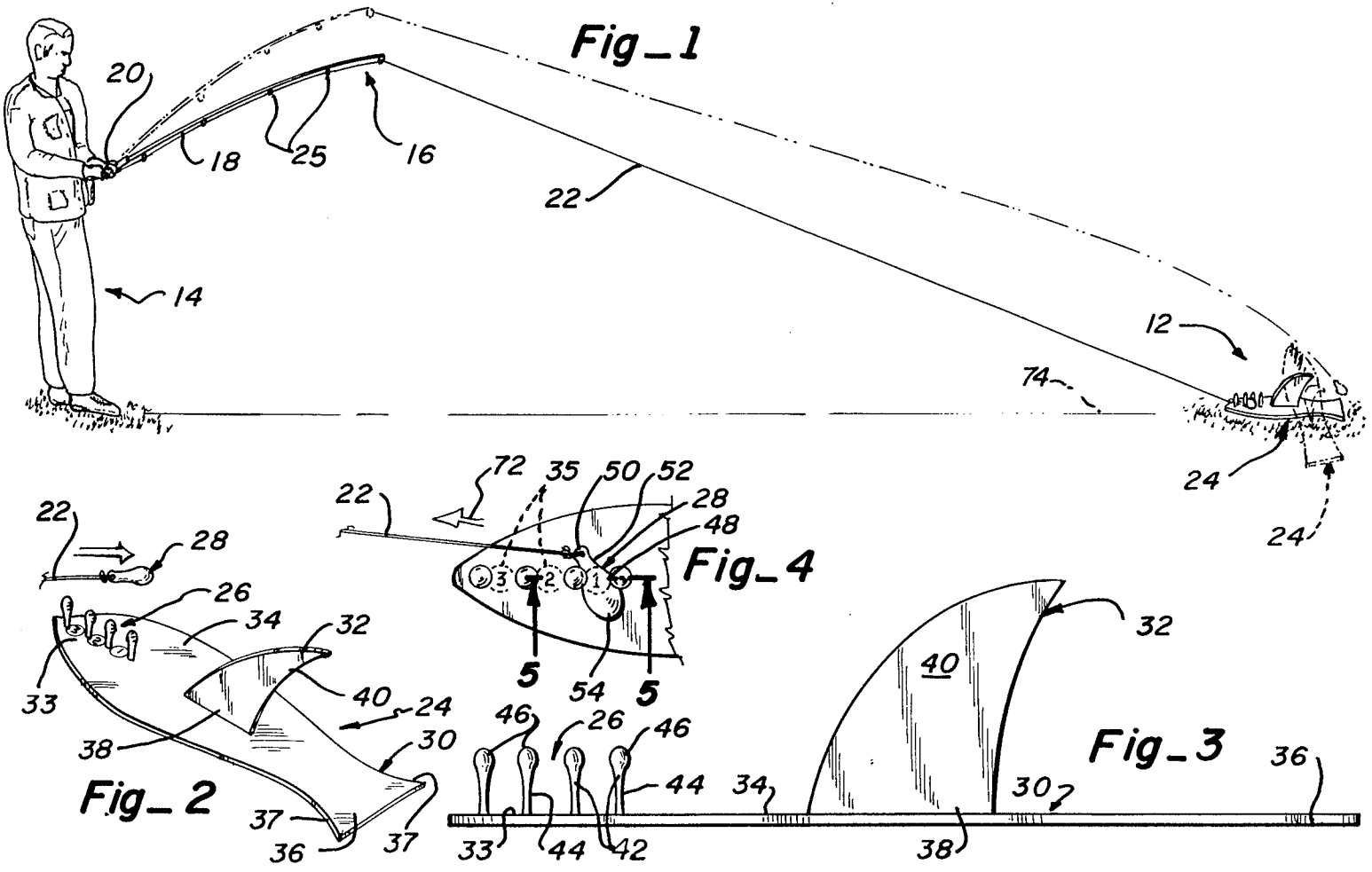
FIG. 1 illustrates an operator utilizing a rod and reel assembly with a yard casting assembly of this invention in a casting operation.
FIG. 2 is a perspective view of the yard casting assembly of this invention illustrating a casting wedge member being cast toward a main target assembly.
FIG. 3 is a side elevational view of the main target assembly of this invention.
FIG. 4 is a fragmentary top plan view showing connection of the casting wedge member with a casting connector assembly on a forward portion of the main target assembly of this invention.

The following is a discussion and description of preferred specific embodiments of the yard casting assembly of this invention, such being made with reference to the drawings, whereupon the same reference numerals are used to indicate the same or similar parts and/or structure. It is to be understood that such discussion and description is not to unduly limit the scope of the invention.

DESCRIPTION OF THE INVENTION

Referring to the drawings in details and, in particular to FIG. 1, a yard casting assembly of this invention, indicated generally at 12, is shown in FIG. 1 being utilized by an operator 14 holding a casting rod and reel assembly 16. The casting rod and reel assembly 16 includes a rod member 18 having a reel member 20 mounted thereon which, in turn, has a fishing line 22 wound thereon in a conventional manner. The rod member 18 is provided with a plurality of spaced eyelets 25 to receive the fishing line 22 therethrough which is normally attached to a fishing lure, fly, or bait for utilization in a fishing endeavor. The operator 14 can be using the yard casting assembly 12 as a game structure or to increase rod and reel casting skills for future use as a fisherman.

The yard casting assembly 12 includes (1) a main target assembly 24 which can be mounted on a support surface being spaced from the operator 14; (2) a casting connector assembly 26 mounted the a main target assembly 24; and (3) a casting wedge member 28 which is connected to the fishing line 22 for use as will be explained.

The main target assembly 24 includes a main base member 30 of a generally fish shape outline having an upright indicator member 32 resembling a shark fin secured to a central area of the main base member 30. The main base member 30 includes a main body section 34 integral with an arcuate tail section 36. The main body section 34 includes a forward section 33 having a plurality of adjacent indicator indicia 35 mounted thereon indicating respective numerals "1"; "2"; and "3" which can be utilized in a method of game play to indicate levels of skill.

The arcuate tail section 36 is provided with opposed arcuate portions 37 operable to engage the grass during movement thereupon to cause a wiggling or transverse motion of the entire main target assembly assembly 24 when being retrieved.

The upright indicator member 32 resembles a shark's fin having a connector section 38 integral with a fin section 40 being secured and perpendicular to the main body section 34.

Figure 5:
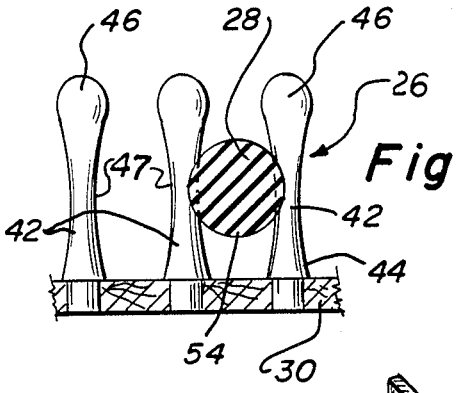
FIG. 5 is an enlarged fragmentary sectional view taken along line 5—5 in FIG. 4.

As noted in FIGS. 3 and 5, the casting connector assembly 26 is provided with a plurality, namely four, catching body members 42 in adjacent relationship and mounted perpendicular to the main base member 30. Each catching body member 42 includes a support section 44 integral with an enlarged head section 46. The support section 44 is anchored through pin and hole connections to the main base member 30 (FIG. 5). The catching body members 42 are each provided with a narrow mid section 47 resembling a neck area on a bowling pin adapted to receive the casting wedge member 28 thereagainst in a wedging type action as noted in FIGS. 4 and 5.

Figure 6:
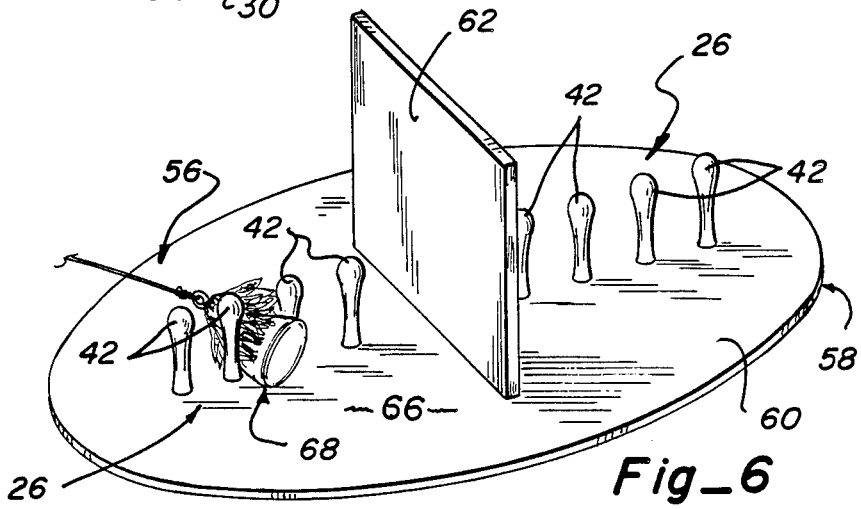
FIG. 6 is a perspective view of a second embodiment of a yard casting assembly of this invention illustrating a casting wedge member mounted between adjacent catching body members.
Figure 7:
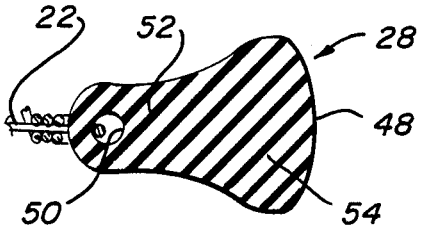
FIG. 7 is a cross-sectional view of the casting wedge member of this invention.
Figure 8:
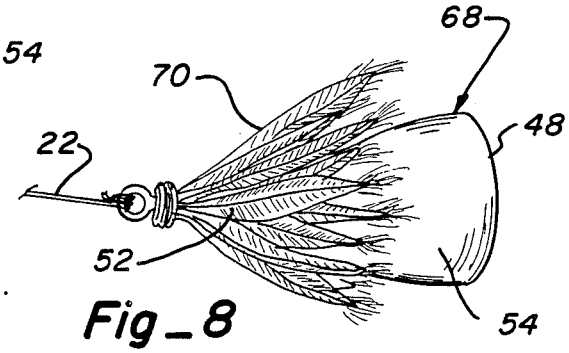
FIG. 8 is a side elevational view of another embodiment of a casting wedge member of this invention.

As noted in FIG. 7, the casting wedge member 28 includes a main body member 48 integral with a connector opening 50 to receive the fishing line 22 therein for an anchoring function. The main body member 48 is provided with a connector section 52 integral with an enlarged wedge section 54. The wedge section 54 is operable to be engaged between adjacent ones of the catching body members 42 against the mid sections 47 as noted in FIG. 6.

The casting wedge member 26 is preferrably constructed of a resilient rubber or plastic material having a desired weight for casting as noted in FIG. 1 plus being resiliently engagably between the adjacent catching body members 42 for a connecting and retrieving operation as will be explained.

In a second embodiment of this invention as noted in FIG. 6, a yard casting assembly 56 is provided including (1) a main target assembly 58; (2) a casting connector assembly 26 mounted on the main target assembly 58; and (3) a casting wedge member 68 connected to the fishing line 22 of the casting rod and reel assembly 16.

The main target assembly 58 includes a main base member 60 of an oval shape having an upright indicator member 62 of square or rectangular shape positioned centrally thereof. The main base member 60 includes a main body section 66 of a plate type construction adapted to be supported on a support surface such as a grassy area or floatable on a water surface similar to the main base member 30 previously described.

The upright indicator member 62 could be provided with indicia thereon of wild animals, fish members, or the like so as to be usable in a method of game play or having points thereon to indicate the importance of catching and retrieving respective main target assemblies 58.

The casting connector assembly 26 includes the catching body members 42 as previously described but having two sets thereof which are mounted in alignment on respective opposite sides of the upright indicator member 62.

The casting wedge member 68 is provided with the main body member 48 as previously described including a plurality of feather members 70 connected to a forward portion of the connector section 52 so as to resemble a casting fly fishing lure. The feather members 70 further operate to aid in visual observance of the casting wedge member 68 after a casting operation.

In a variation of the yard casting assembly 56, the main base member 60 is constucted of a floatable material in a circular shape with a plurality of adjacent body members 42 placed on an outer periphery of the circular main base member 60. Between each catching body member 42 is an indicator indicia 35 of a different numeral such as 1–36 which is used in a method of game play to be described.

Figure 9:
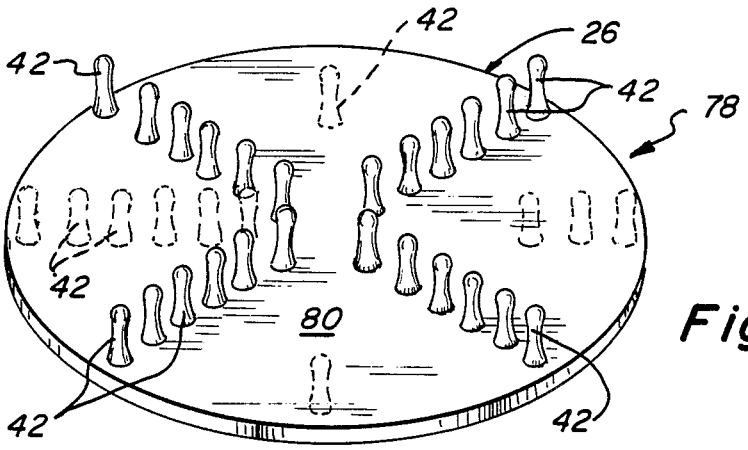
FIG. 9 is a perspective view of a third embodiment of a yard casting assembly of this invention.
Figure 11:
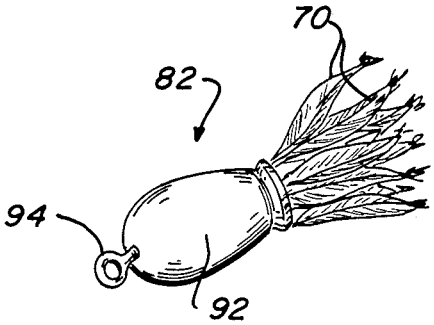
FIG. 11 is a perspective view of a further embodiment of a casting wedge member of this invention.

In another embodiment as shown in FIG. 9, a yard casting assembly 78 includes a circular main target assembly 80 having a plurality of rows of casting connector asemblies 26 thereon to be used with a casting wedge member 82 (FIG. 11).

Figure 10:
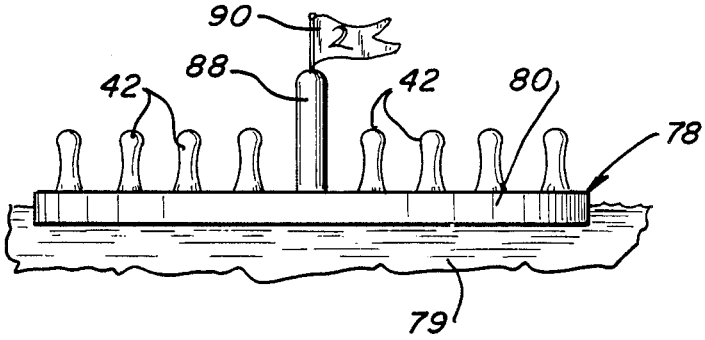
FIG. 10 is a side elevational view of a fourth embodiment of a yard casting assembly of this invention floating in a body of water.

The main target assembly 80 is constructed of a buoyant material so as to be floatable in a body of water 79 as noted in FIG. 10.

Each casting connector assembly 26, as noted in solid lines in FIG. 9, consists of six (6) catching members 42 arranged in separate quadrants.

It is obvious that any number of rows of catching members 42 can be used as an additional four (4) rows as illustrated in partial dotted lines in FIG. 9.

In another embodiment as shown in FIG. 10, a yard casting assembly 81 includes the main target assembly 80 having two (2) aligned rows of four (4) catching members 42 with an upright indicator member 86 therebetween.

The upright indicator member 86 includes a support post 88 with a flag member 90 mounted thereon.

The casting wedge member 82 includes a main body member 92 having feather members 70 on a rear area and a connector ring 94 on a front end for attachment to the fishing line 22. The main body member 92 is of a size and shape to become wedge between adjacent ones of the catching members 42 in a manner to be described.

USE AND OPERATION OF THE INVENTION

In the use and operation of the yard casting assembly 12 of this invention, it is noted that the main target assembly 24 can be constructed to resemble different fish species such as a shark, a catfish, or a bass and a plurality of the main target assemblies 24 can be provided so as to provide either a game of practice for a fisherman or a game structure for an overall method of game play.

As noted in FIG. 1, the main target assembly 24 is placed outwardly away from the operator 14 and mounted on a support surface 74 which may be grassy area or a water surface such as a lake, pond, or swimming pool.

Next, the operator 14 attaches the casting wedge member 28 to an outer end of the fishing line 22 and retrieves subject fishing line 22 within the reel member 20 for a casting operation. Thereupon, the operator 14, in a conventional manner, casts the casting wedge member 28 outwardly as shown in dotted lines in FIG. 1.

Then, the fishing line 22 can be retrieved by the operator 14 through conventional operation of the reel member 20. The object of the yard casting assembly 12 would be to retrieve the fishing line 22 between adjacent upright ones of the catching body members 42 in order to wedge the casting wedge member 28 therebetween as noted in FIG. 4.

On achieving the weding action, the fishing line 22 is retrieved as noted by an arrow 72 in FIG. 4 whereupon the entire main target assembly 24 can be retrieved back to a position adjacent the operator 14.

The arcuate tail section 36 and, more particularly, the arcuate portions 37 engage the grassy structure on the support surface 74 to achieve a wiggling or reciprocating movement of the main target assembly 24 to resemble the actual catching and retrieving of a fish member.

In a method of game play, the operator 14 can achieve a running score depending (1) on the number of main target assemblies 24 to be retrieved; and (2) whether the casting wedge member 28 is wedged between catching body members 42 indicated by the indicator indicia 35 as being credited with three points rather than one point as indicated by the indicator indicia 35 (FIG. 4).

In the second embodiment of the yard casting assembly 56, it is noted that the main base member 60 is of a generally oval shape to be mounted on the support surface 74. The upright indicator member 62 can be provided with various indicia thereon such as pictures of elephants, lions, zebras, and the like to be utilized as a method of game play.

The casting wedge member 68 is operable as previously described for the casting wedge member 28 to be placed between adjacent ones of the catching body members 42 as noted in FIG. 6.

The casting wedge member 68 is provided with the feather members 70 to more accurately resemble the casting of a fly fishing lure. The main base member 60 may be provided with the indicator indicia 35 between the catching body members 42 so as to establish levels of game play skill in the use thereof.

The main base member 60 or 84 can be (1) constructed of a floatable material; (2) circular in shape; and (3) provided with the catching body members 42 about an outer periphery or in a plurality of intersection rows. Then, this embodiment of the main target assembly 58 or 80 can be used floating in a swimming pool, similar to a dart board, for practice by the operator 14 to increase fishing skills.

A method of game play or improving a casting skill level of an operator 14 using the casting rod and reel assembly 16 with the yard casting assembly (12, 56 or 78) of this invention involving the steps of:

(1) securing a casting wedge member (28, 68 or 82) to an outer end of the fishing line 22;

(2) placing the main target assembly (24, 58 or 80) a distance from the operator 14 on a support surface 74 which may be a grassy surface or a water surface;

(3) casting the fishing line 22 with the casting wedge member (28, 68 or 82) toward the main target assembly (24, 58 or 80);

(4) retrieving the fishing line 22 between adjacent ones of the catching body members 42 of the casting connector assembly 26;

(5) retrieving the fishing line 22 to cause the casting wedge member (28, 68 or 82) to wedge same same between said catching body members 42; and (6) retrieving the fishing line 22 and interconnected casting wedge member (28, 68 or 82) to transfer the main target assembly (24, 58 or 80) to the operator 14 to simulate a fishing casting operation.

A further step in the method of using the yard casting assembly (12, 56 or 78) of this invention involves counting a number indicia shown by the indicator indicia 35 between the catching body members 42 to arrive at a score indicating a winner in a method of game play.

As noted in FIGS. 9 and 10, the yard casting assembly 78 may be of a circular or irregular shape being floatable on the body of water 79 having various embodiments in the number of rows of the catching members 42.

Further, the catching members 42 can be of various configurations being such that the fishing line 22 can move between upper adjacent portions and the casting wedge member (28, 68, or 82) secured to subject fishing line 22 becomes wedged between adjacent catching members 42 as noted in FIGS. 4, 5, and 6.

It is obvious that the main target assembly can be constructed of various sizes and shapes even to represent an outline of an octopus with rows of catching members placed on curving octopus tentacles.

The yard casting assembly embodiments of this invention can be used as targets during bass fishing tournaments in tests of skill to replace the present use of floating rings.

The yard casting assembly can be utilized either as a game structure having a method of game play or by a fisherman in order to practice and improve his casting skills for later use in a body of water in a fishing operation.

The yard casting assembly of this invention is easy to use; economical to manufacture; substantially maintenace free; and provides a great amount of entertainment and/or practice for improving fishing skills.

While the invention has been described in conjunction with preferred specific embodiments thereof, it will be understood this description is intended to illustrate and not to limit the scope of the invention, which is defined by the following claims:

I claim:

1. A yard casting assembly operable with a casting rod and reel assembly having a fishing line, comprising:

(a) a main target assembly having a casting connector assembly mounted thereon;

(b) a casting wedge member connectable to the fishing line and engagable with said casting connector assembly in a wedging action;

(c) said main target assembly is provided with a main base member having an upright indicator member mounted thereon;

(d) said main base member resembling the outline of a fish member having a main body section integral with an arcuate tail section; and (e) said arcuate tail section having arcuate portions engagable with a grassy support surface in order to simulate a wiggling fish structure on being retrieved by movement of the fishing line and said casting wedge member between said casting connector assembly;

whereby an operator of the casting rod and reel assembly can retrieve the fishing line and interconnected casting wedge member so as to engage said casting connector assembly and move said meain target assembly to the operator to simulate a fish catching operation.

2. A yard casting assembly as described in claim 1, wherein:

(a) said upright indicator member resembles a fin of a shark member so as to provide a readily visually observable target member.

3. A yard casting assembly as described in claim 1, wherein:

(a) said casting connector assembly having a plurality of adjacent catching body members; and (b) said casting wedge member having a main body member to be cast outwardly and wedged between said catching body members.

4. A yard casting assembly operable with a casting rod and reel assembly having a fishing line in order to improve fishing skills of an operator, comprising:

(a) a main target assembly having (1) a main base member resembling an outline of a fish structure; and (2) an upright indicator member resembling a fin of the fish structure;

(b) a casting connector assembly including a plurality of adjacent catching body members secured to said base member adjacent a mouth section of the fish structure; and (c) a casting wedge member connectable to the fishing line and operable to be selectively engaged between adjacent ones of said catching body members in a wedging action.

5. A yard casting assembly as described in claim 4, wherein:

(a) said catching body members including a catching body member with a main support section and an enlarged head section and operable to receive said casting wedge member therebetween in a wedged condition in order to pull the said main base member on retrieving of the fishing line by the operator of the casting rod and reel assembly.

6. A yard assembly as described in claim 4, wherein:

(a) said casting wedge member of a generally circular oval tapered shape and constructed of a resilient material so as to be readily engagable between and wedged with said catching body members.

7. A yard casting assembly as described in claim 6, wherein:

(a) said casting wedge member is provided with a plurality of feather members to resemble a fly casting lure member.

8. A yard casting assembly operable with a casting rod and reel assembly having a fishing line in order to improve fishing skills of an operator, comprising:

(a) a main target assembly having a main base member constructed of a floatable material for use on a water surface;

(b) a casting connector assembly having a plurality of adjacent catching body members mounted about an outer periphery of said main base member; and (c) a casting wedge member connectable to the fishing line and operable to be cast by the operator using the rod and reel assembly and engaged between adjacent ones of said catching body members;

whereby the operator casts said casting wedge member toward said main target assembly in order to place the fishing line between adjacent ones of said catching body members and retrieves the fishing line to place and wedge said casting wedge member between said casting wedge member so that said main target assembly can be retrieved to the operator similar to a fish catching operation.

9. A yard casting assembly as described in claim 8, wherein:

(a) said main base member of a circular shape and having indicator indicia between adjacent ones of said catching body members;

whereby said indicator indicia used in a method of game play to indicate levels of game skill and means to indicate winners in a game situation.

10. A yard casting assembly as described in claim 9, wherein:

(a) said indicator indicia having number members to indicate levels of skill similar to a dart board.

11. A method of obtaining skill of an operator with a casting rod and reel assembly having a fishing line mounted thereon and using a yard casting assembly having (1) a casting wedge member; and (2) a main target assembly having a casting connector assembly therebetween, comprising the following steps:

(a) securing a casting wedge member to an outer end of the fishing line connected to the casting rod and reel assembly;

(b) placing a main target assembly at a distance from the operator using the casting rod and reel assembly;

(c) casting the fishing line with said casting wedge member mounted thereon toward said main target assembly;

(d) retrieving the fishing line to place said casting wedge member into engagement between adjacent catching body members of a casting connector assembly so as to achieve a wedging action; and (e) retrieving the fishing line to move the interconnected said main target assembly toward the operator of the casting rod and reel assembly.

12. A method of utilizing the yard casting assembly as described in claim 11, wherein:

(a) counting a score on the retrieved said main target assembly determined by the placement of said casting wedge member into engagement between adjacent ones of said catching body members having indicator indicia therebetween to achieve a score indicating skill in the casting operation.

13. A method of utilizing the yard casting assembly as described in claim 11, wherein:

(a) placing said main target assembly being constructed of a floatable material on a surface of water to simulate a rod and reel casting operation.

14. A yard casting assembly operable with a casting rod and reel assembly having a fishing line, comprising:

(a) a main target assembly having a casting connector assembly mounted thereon;

(b) a casting wedge member connectable to the fishing line and engagable with said casting connector assembly in a wedging action; and (c) said casting connector assembly having a plurality of adjacent catching body members having indicator indicia mounted therebetween;

whereby an operator of the casting rod and reel assembly can retrieve the fishing line and interconnected casting wedge member so as to engage said casting connector assembly and move said main target assembly to the operator to simulate a fish catching operation; and whereby said indicator indicia is provided with skill indicia so that placement of said casting wedge member between respective ones of said catching body members can be indicative of one's casting skill through the use of said indicator indicia.

15. A yard casting assembly operable with a casting rod and reel assembly having a fishing line, comprising:

(a) a main target assembly having a casting connector assembly mounted thereon;

(b) a casting wedge member connectable to the fishing line and engagable with said casting connector assembly in a wedging action;

(c) said main target assembly includes a main base member having an upright indicator member; and (d) said casting connector assembly includes a plurality of adjacent catching body members mounted on opposed sides of said upright indicator member to selectively receive said casting wedge member therebetween;

whereby an operator of the casting rod and reel assembly can retrieve the fishing line and interconnected casting wedge member so as to engage said casting connector assembly and move said main target assembly to the operator to simulate a fish catching operation.

16. A yard casting assembly as described in claim 15, wherein:

(a) said upright indicator member having indicator indicia thereon operable in a method of game play to indicate levels of game play skill.

17. A yard casting assembly operable with a casting rod and reel assembly having a fishing line, comprising:

(a) a main target assembly having a casting connector assembly mounted thereon;

(b) a casting wedge member connectable to the fishing line and engagable with said casting connector assembly in a wedging action;

(c) said main target assembly of a circular shape constructed of a material for flotation on a body of water; and (d) said casting connector assembly having a plurality of intersecting rows of catching members extended in one direction from said main target assembly;

whereby an operator of the casting rod and reel assembly can retrieve the fishing line and interconnected casting wedge member so as to engage said casting connector assembly and move said main target assembly to the operator to simulate a fish catching operation.

18. A yard casting assembly operable with a casting rod and reel assembly having a fishing line, comprising:

(a) a main target assembly having a casting connector assembly mounted thereon;

(b) a casting wedge member connectable to the fishing line and engagable with said casting connector assembly in a wedging action; and (c) said main target assembly of an irregular shape and said casting connector assembly having a plurality of rows of said catching members of irregular shape;

whereby an operator of the casting rod and reel assembly can retrieve the fishing line and interconnected casting wedge member so as to engage said casting connector assembly and move said main target assembly to the operator to simulate a fish catching operation.

19. A yard casting assembly operable with a casting rod and reel assembly having a fishing line, comprising:

(a) a main target assembly having a casting connector assembly mounted thereon;

(b) a casting wedge member connectable to the fishing line and engagable with said casting connector assembly in a wedging action;

(c) said casting connector assembly having more than one adjacent catching body member; and (d) said casting wedge member operable to be selectively engaged between said catching body members for retrieving said main target assembly by the operator of the casting rod and reel assembly.

20. A yard casting assembly as described in claim 19, wherein:

(a) said casting wedge member constructed of a resilient material so as to be readily engagable between and wedged with said catching body members.

21. A yard casting assembly as described in claim 19, wherein:

(a) said main target assembly includes a main base member having an indicator member mounted thereon to provide a readily observable target member.

* * * * *